US006281745B1

(12) United States Patent
Kim et al.

(10) Patent No.: US 6,281,745 B1
(45) Date of Patent: Aug. 28, 2001

(54) INTERNAL POWER SUPPLY VOLTAGE GENERATING CIRCUIT OF SEMICONDUCTOR MEMORY DEVICE

(75) Inventors: Jae Hoon Kim, Suwon; Hyun Soon Jang; Hoon Ryu, both of Seoul, all of (KR)

(73) Assignee: Samsung Electronics Co., Ltd., Kyoungki-do (KR)

( * ) Notice: Subject to any disclaimer, the term of this patent is extended or adjusted under 35 U.S.C. 154(b) by 0 days.

(21) Appl. No.: 09/511,848

(22) Filed: Feb. 23, 2000

(30) Foreign Application Priority Data

Sep. 1, 1999 (KR) ..... 99-36855

(51) Int. Cl.[7] ..... G05F 3/02
(52) U.S. Cl. ..... 327/541
(58) Field of Search ..... 327/525, 538, 327/540, 541, 544; 326/80, 81

(56) References Cited

U.S. PATENT DOCUMENTS 5,298,807 * 3/1994 Salmon et al. ..... 307/475
5,321,653 * 6/1994 Suh et al. ..... 365/189.09
5,982,162 * 11/1999 Yamauchi ..... 323/316
6,097,113 * 8/2000 Teraoka et al. ..... 307/125

* cited by examiner

*Primary Examiner*—Jeffrey Zweizig
(74) *Attorney, Agent, or Firm*—Skjerven Morrill MacPherson LLP; David W. Heid

(57) ABSTRACT

A flexible internal power supply voltage generating circuit of a semiconductor memory device includes a step-down circuit and a selection circuit. The selection circuit selects the step-down circuit for use when the semiconductor device uses a high external power supply voltage but bypasses the step-down circuit for a low external power supply voltage. One such circuit additionally includes a power supply terminal and a control circuit. The power supply terminal receives an external power supply voltage. The control circuit compares a feedback internal power supply voltage with a reference voltage at the time of driving a word line and then generates a control voltage signal for controlling a DIP of an internal power supply voltage caused by driving the word line. A selection circuit selectively connects a high voltage node or a low voltage node to the power supply terminal according to the external power supply voltage. The step-down circuit connects to the high voltage node and reduces the external power supply voltage when the power supply terminal receives the high supply voltage. The driver is between a common connection point of the step-down circuit and the low voltage node and an internal circuit and drives the external power supply voltage in the internal circuit in response to the control signal. Accordingly, when a high voltage is applied, the high voltage is stepped down and provided to the driver, thereby controlling a reverse overshoot of the internal power supply voltage.

5 Claims, 4 Drawing Sheets

INTERNAL POWER SUPPLY VOLTAGE GENERATING CIRCUIT OF SEMICONDUCTOR MEMORY DEVICE

BACKGROUND OF THE INVENTION

1. Field of the Invention

The present invention relates to an internal power supply voltage generating circuit and to reducing overshoot caused when a feedback control responds to a drop in the internal power supply voltage.

2. Description of the Related Art

High-capacity semiconductor memory devices such as DRAMs having storage capacity greater than 64 Mbits commonly use a low supply voltage (typically 3.3 V or less) to reduce power consumption. However, other DRAMs, integrated circuits and systems use a higher supply voltage (typically about 5 V). Accordingly, a flexible semiconductor memory device should be able to utilize either power supply.

Conventionally, a semiconductor memory device includes an internal power supply voltage generating circuit that generates a stable internal supply voltage from the external supply voltage. When a word line is enabled, the semiconductor memory device consumes a relatively large amount of power, which can cause the voltage level of the internal power supply voltage to drop. This is commonly called as a DIP. If a DIP causes the internal supply voltage to remain low, the low supply voltage can create a fatal error in the circuit.

To improve response to a DIP, an internal power supply voltage generating circuit can use a feedback system. When a DIP occurs, the feedback system detects a voltage drop and increases the driving ability of the internal power supply to rapidly recover a normal voltage level. However, the conventional method, which increases the driving ability to improve response to a DIP, can cause an overshoot where the internal voltage rises above the desired level. The overshoot can be serious enough to cause a fatal error in the internal circuit. Specially, with a low external supply voltage of 3.3 V, the overshoot is typically small and does cause serious errors, but an overshoot with a high external supply voltage of 5 V can causes a fatal error.

One way to decrease the problems with overshoot is to improve the current capacity of the internal power supply to reduce DIP and the need for a feedback response. Increasing current capacity typically requires enlarging the capacitance of the power supply circuit to improve response to a DIP. Accordingly, the capacitance for the power supply circuit occupies a large area in a chip and increases the total IC area and cost. Another way to decrease problems with overshoot is to reduce or eliminate occurrences of DIP. This method increases recovery time and reduces the current charging word lines, but this method changes the operating speed of the chip.

Another concern in the internal supply voltage generating circuit is that the circuits that solve the problem of overshoot for a high external supply voltage of 5 V can have detrimental consequences when used with a low external supply voltage of 3.3 V.

SUMMARY OF THE INVENTION

In accordance with an aspect of the present invention, an internal supply voltage generator of a semiconductor memory device provides a selectable driver with a set-down circuit to reduce overshoot caused by a high external supply voltage. For a low external supply voltage, the driver directly drives an internal supply voltage without doing anything. For a high external supply voltage, the driver provides the high external supply voltage through the step-down circuit.

One embodiment of the invention is a device that includes a control circuit, a selection circuit, a step-down circuit, and a driver. The control circuit generates a control signal having a first voltage in a normal mode and a second voltage when controlling a DIP of an internal supply voltage. The control circuit compares the internal power supply voltage with a reference voltage when a word line is driven. The selection circuit includes a common node connected to the power supply terminal, a high voltage node and a low voltage node. The selection circuit selectively connects the high voltage node or the low voltage node to the common node according to the level of the external supply voltage. The step-down circuit, which typically includes a resistor or a MOS diode, connects to the high voltage node and serves to step down the external power supply voltage. The driver is between an internal circuit and a common connection point of the step-down circuit and the low voltage node. The driver provides the power supply voltage to the internal circuit in response to the control signal.

DETAILED DESCRIPTION OF THE INVENTION

Figure 1:
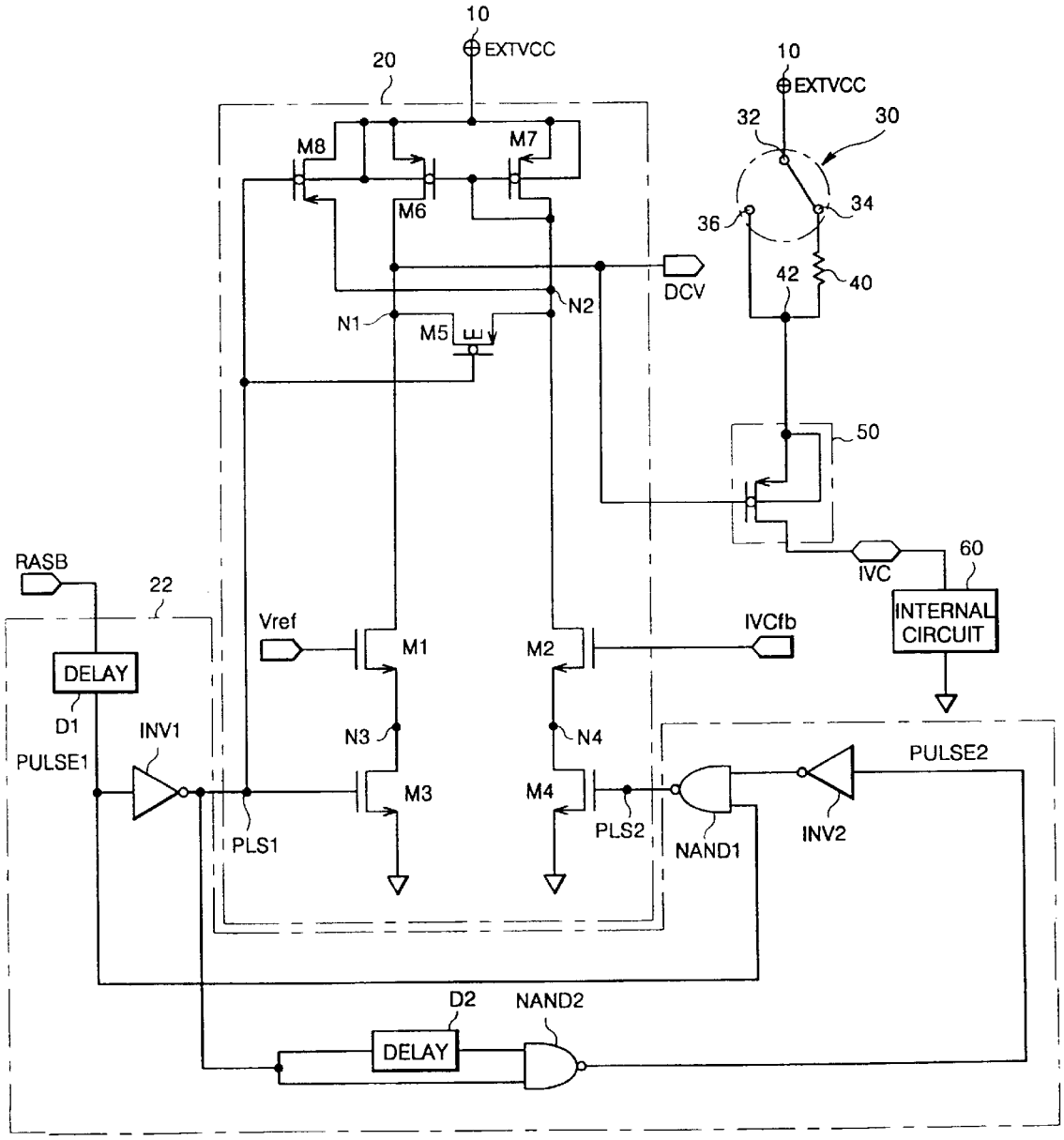
FIG. 1 is a circuit diagram of an internal supply voltage generating circuit of a semiconductor memory device according to an embodiment of the present invention.

FIG. 1 is a circuit diagram of an internal supply voltage generating circuit 100 of a semiconductor memory device according to an embodiment of the present invention. Generating circuit 100 includes a control circuit 20, a signal generator 22, a selection circuit 30, a step-down circuit 40, and a driver 50.

The control circuit 20 includes eight transistors M1 to M8. The first transistor M1, which is an N-channel transistor between an output node N1 and a node N3, has a gate at a reference voltage Vref. The second transistor M2, which is an N-channel transistor between nodes N2 and N4, has a gate at an internal power supply voltage IVCfb. The third transistor M3, which is an N-channel transistor between the node N3 and a ground voltage VSS, has a first enable signal PLS1 applied to its gate. The fourth transistor M4, which is an N-channel transistor between the node N4 and a ground voltage VSS, has a second enable signal PLS2 applied to its gate. The fifth transistor M5, which is P-channel transistor between the nodes N1 and N2, has the first enable signal PLS1 applied to its gate. The sixth transistor M6, which is a P-channel transistor between a power supply terminal 10 and the output node N1, has a gate coupled to the node N2. The seventh transistor M7, which is a P-channel transistor between the power supply terminal 10 and the node N2, has a gate coupled to the second output node N2. The eighth transistor M8, which is a P-channel transistor between the power supply terminal 10 and the node N2, has the first enable signal PLS1 applied to its gate.

In signal generator 22, generates enable signals PSL1 and PLS2 from a row strobe signal RASB such as currently used in DRAMs. The row strobe signal RASB is an active low signal, and a delay D1 generates a first pulse signal PULSE1 as a delayed version of the row strobe signal RASB. An inverter INV1 generates the first enable signal PLS1 from a first pulse signal PULSE1. Thus, the first enable signal PLS1 has an active (high) region of the same duration as the active region of the row strobe signal RASB. The active region (or a non-active region) of the first enable signal PLS1 turns the third transistor M3 on (or off) and turns the fifth and eighth transistors M5 and M8 off (or on).

A delay D2 and a NAND gate NAND2 generate a second pulse signal PULSE2 from the first enable signal PLS1. The second pulse signal PULSE2 has a leading edge that is delayed relative to the leading edge of the first pulse signal, and a trailing edge that nearly coincides with a trailing edge of the first pulse signal. Accordingly, the second pulse signal PULSE2 is active (low) at a trailing edge of the row strobe signal RASB.

A NAND gate NAND1 and an inverter INV2 generate the second enable signal PLS2 from the first pulse signal PULSE1 and a second pulse signal PULSE2. The second enable signal PLS2 has an active (high) region between the leading edge of the first pulse signal PULSE1 and the leading edge of the second pulse signal PULSE2. The active and the non-active regions of the second enable signal PLS2 turn the fourth transistor M4 on and off, respectively.

The selection circuit 30 includes a common node 32, a high voltage node 34, and a low voltage node 36. The common node 32 connects to the power supply terminal 10, the high voltage node 34 connects to one end of the step-down circuit 40, and the low voltage node 36 is connected to the driver 50. A bonding option, a fuse option, or a metal option during integrated circuit fabrication can be used to determine whether the selection circuit 30 connects the common node 32 to the high voltage node 34 or the low voltage node 36.

Figure 2:
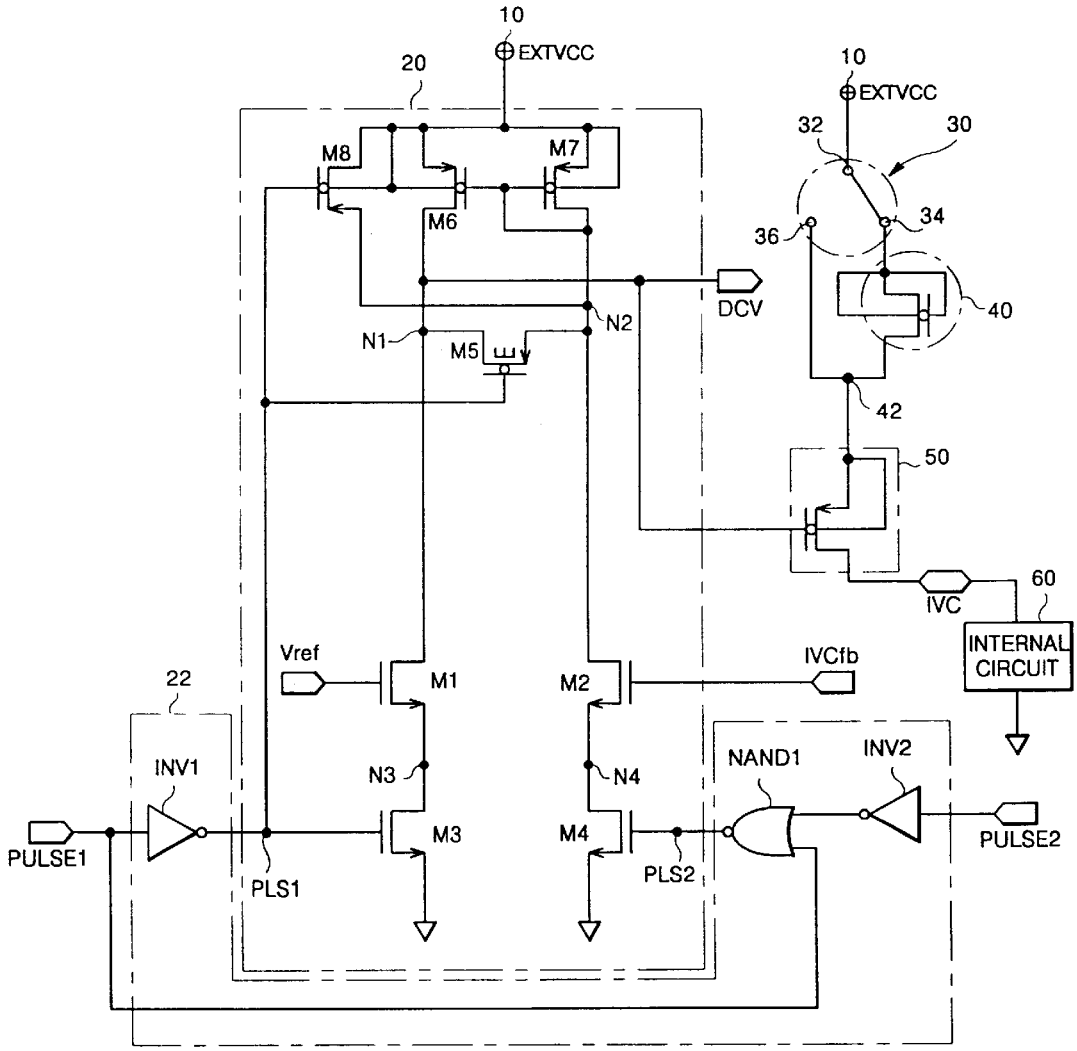
FIG. 2 is a circuit diagram of an internal supply voltage generating circuit of a semiconductor memory device according to another embodiment of the present invention.

In FIG. 1, the step-down circuit 40 is a resister. Alternatively, as illustrated in FIG. 2, the step-down circuit 40 can be MOS transistor or diode. Specifically, in FIG. 2, the step-down circuit 40 is a PMOS transistor that is diode connected (i.e., has its gate and source coupled together). Other embodiments of the invention can employ alternative step-down circuits.

Figure 3:
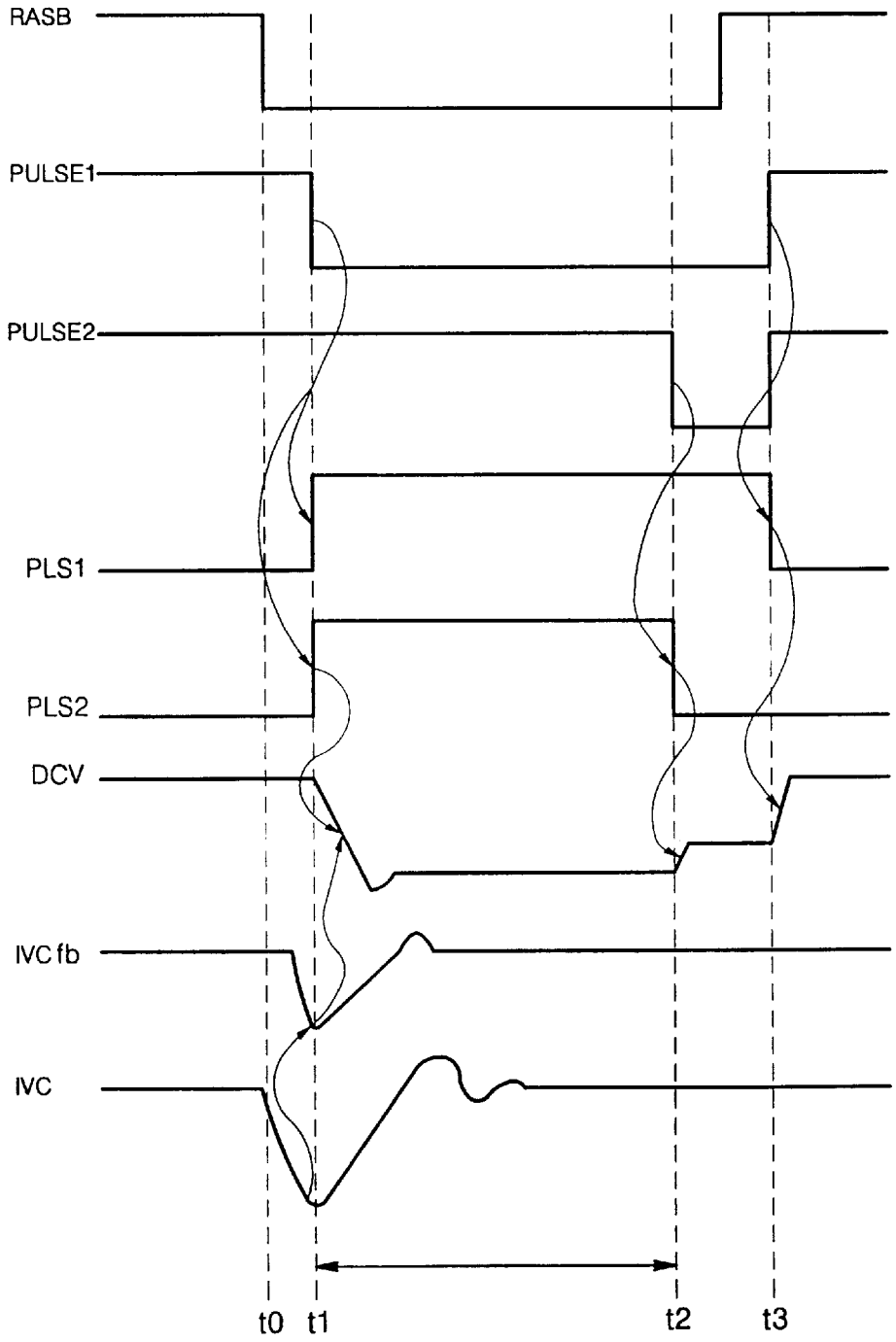
FIG. 3 is a timing chart illustrating operation of the internal supply voltage generating circuit of FIG. 1 or FIG. 2.

The driver 50 includes a PMOS transistor with a source connected to a common connection point of the step-down circuit 40 and the low voltage node 36. A drain of the PMOS transistor connects to the internal circuit 60. Typically, the internal circuit 60 includes circuitry (not shown) that provides internal supply voltage IVC. That circuitry may be unable to maintain supply voltage IVC at a suitable level when internal circuit 60 draws a high current, for example, when charging a word line in a memory device such as a DRAM. To maintain the internal voltage, the control circuit 20 applies a control signal DCV to a gate of the PMOS transistor, causing the driver 50 to supply power from the power supply terminal 10 to internal circuit 60 when the internal supply voltage IVC is low. An example of the operation of the internal power supply voltage generating circuit 100 is described below with reference to a timing diagram of FIG. 3. For this example operation, the external power supply terminal 10 receives a high voltage external supply voltage (e.g., 5 V), and the internal power supply circuit 100 provides an internal power supply voltage IVC to the internal circuit 60. Selection circuit 30 connects the power supply terminal 10 to the high voltage node 34, via common node 32.

At output node N1, the control circuit 20 generates a control signal DCV that operates the driver 50. The enable signals PLS1 and PLS2 are initially inactive (low). The inactive enable signal PLS1 turns 30 the fifth and eighth transistors M5 and M8 on and turns the transistor M3 off. The inactive enable signal PLS2 turns transistor M4 off. Accordingly, transistors M5 and M8 drive the first control signal DCV to a high voltage, and the first control signal DCV turns off the river 50.

Subsequently, at a time t0, the row address strobe signal RASB transits to its active state (low), and the internal circuit 60 draws current, for the charging of a row line. In response, the internal power supply voltage IVC begins to drop. More specifically, the large current causes a DIP when a word line is enabled. Neither the first nor the second pulse signals PULSE1 and PULSE2 is active at time t0. Accordingly, signal generator 22 provides the first and second enable signals PLS1 and PLS2 with the low voltage, which keeps transistors M5 and M8 on and transistors M3 and M4 off.

The leading edge of signal PULSE1 is delayed relative to the leading edge of signal RASB and occurs at time t1. Accordingly, at time t1, the signal generator 22 raises the first and second enable signals PLS1 and PLS2 to high, which turns off the transistors M5 and M8 and turns on the transistors M3 and M4. The transistors M1 and M2 effectively compare the reference voltage Vref with the feedback internal supply voltage IVCfb. If the feedback internal supply voltage IVCfb is low relative to the reference voltage Vref, the transistor M1 conducts more current than the transistor M2, which allows transistors M1 and M3 to pull down the output node N1 and the control signal DCV. Accordingly, at time t1 during a DIP, the control voltage DCV begins to drop causing the driver 50 to provide an increasing current to the internal circuit 60. A DIP of the internal power supply voltage thus rapidly recovers to a normal level. In this recovery operation, a high voltage of 5 V provides a larger current than a low voltage of 3.3 V would provide, and in a conventional circuit, this could cause a large reverse overshoot. In accordance with an aspect of the invention, the step-down circuit 40 controls the current from the power supply voltage 10 and thereby limits the current through the driving means 50 and an overshoot.

Between, times t1 and t2, the control circuit 20 continues to adjust the control signal through the driver 50 so that the feedback internal supply voltage IVCfb matches the reference voltage Vref. At time t2, the second enable signal PLS2 becomes inactive, and the control circuit 20 raises the control signal DCV to a reference level. At time t3, the first enable signal PLS1 becomes inactive, and the control signal DCV rises to cut off the current through the driver 50.

Figure 4:
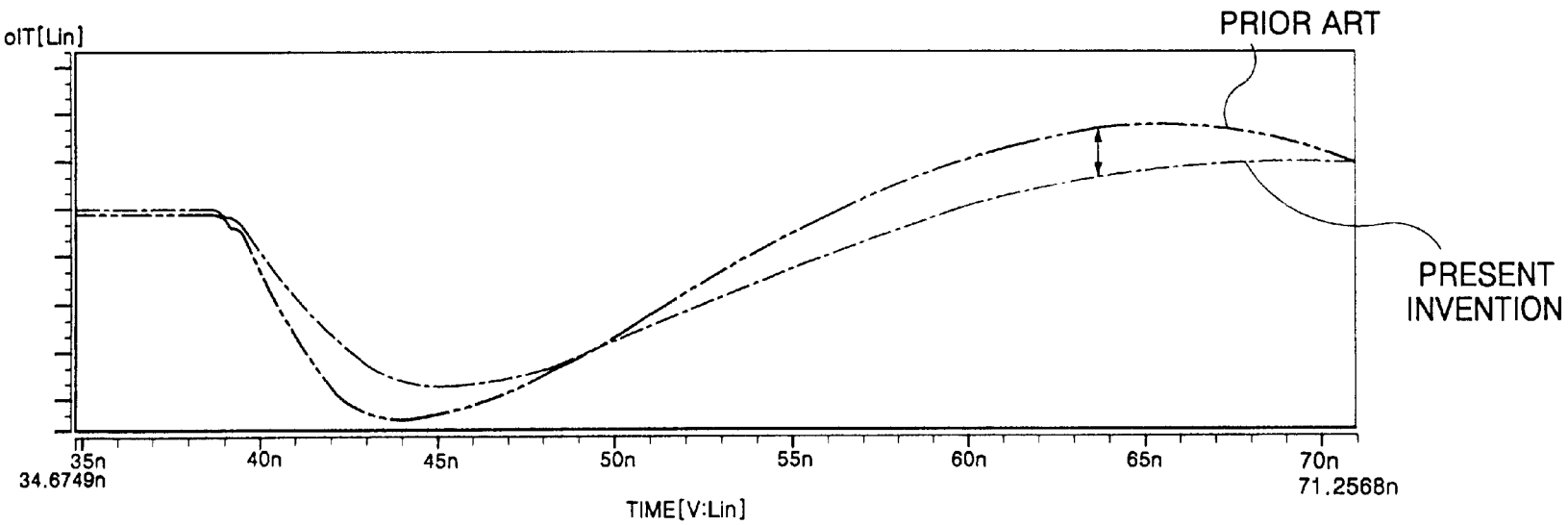
FIG. 4 is a timing chart illustrating an improvement that an internal power supply voltage generator according to the present invention achieves in a voltage overshoot.

FIG. 4 shows a result of improving the overshoot when the step-down circuit 40 is a resistor of 200Ω. The present invention as shown in FIG. 4 can reduce the overshoot between about 50 mV and about 70 mV in comparison with an internal circuit adopting no step-down circuit.

As described above, the internal supply voltage circuit uses a step-down circuit, e.g., a resistor or a MOS transistor, to limit the recovery current that a power supply terminal provides for a DIP, thereby controlling a reverse overshoot. Accordingly, the present invention can be adapted to a circuit, a layout, or a product after the design stage, simply by tuning the resistance or size of the resistor or transistor.

Although the invention has been described with reference to particular embodiments, the description is only an example of the invention's application and should not be taken as a limitation. Various adaptations, omissions, and combinations of features of the embodiments disclosed are within the scope of the invention as defined by the following claims.

What is claimed is:

1. An internal power supply voltage generating circuit of a semiconductor device comprising:

a power supply terminal to which an external supply voltage is applied;

a control circuit that generates a control signal having a voltage that depends on a comparison of a reference voltage and an internal supply voltage when a word line is driven;

a selection circuit that includes a common node connected to said power supply terminal, a high voltage node and a low voltage node, the selection circuit selectively connecting said high voltage node or said low voltage node to said common node in accordance with a level of the external supply voltage;

a step-down circuit connected to said high voltage node; and a driver connected between a common connection point of said step-down circuit and said low voltage node and an internal circuit, said driver providing said external power supply voltage to the internal circuit in response to said control signal.

2. The circuit as claimed in claim 1, wherein said step-down circuit consists of a resister.

3. The circuit as claimed in claim 1, wherein said step-down circuit consists of a MOS diode.

4. The circuit as claimed in claim 1, wherein said selection circuit selectively connects said common node to said high voltage node or said low voltage node by way of a structure selected from a group consisting of a bonding option, a fuse option, or a metal option.

5. The circuit as claimed in claim 1, wherein said control circuit comprises:

a first transistor connected between a first output node and a first node, while a reference voltage is applied to a gate of the first transistor;

a second transistor connected between a second output node and a second node, while a feedback internal power supply voltage is applied to a gate of the second transistor;

a third transistor connected between said first node and a ground voltage, wherein a first enable signal is applied to a gate of said third transistor and an active region of said first enable signal turns on said third transistor;

a fourth transistor connected between said second node and said ground voltage, wherein a second enable signal is applied to a gate of the fourth transistor and an active region of said second enable signal turns on said fourth transistor;

a fifth transistor connected between said first output node and said second output node, wherein said first enable signal is applied to a gate of the fifth transistor, and a non-active region of said first enable signal turns on said fifth transistor;

a sixth transistor connected between said power supply terminal and said first output node, wherein a gate of the sixth transistor is connected to said second output terminal;

a seventh transistor connected between said power supply terminal and said second output node, wherein a gate of the seventh transistor is connected to said second output node; and an eighth transistor connected between said power supply terminal and said second output node, wherein said first enable signal is applied to a gate of the eighth transistor and a non-active region of said first enable signal turns on said eighth transistor.

* * * * *